US008698017B2

(12) United States Patent
Mizukoshi et al.

(10) Patent No.: US 8,698,017 B2
(45) Date of Patent: Apr. 15, 2014

(54) SWITCH DEVICE

(75) Inventors: Takeo Mizukoshi, Saitama (JP); Yoshitaka Yamada, Tochigi (JP); Koji Mori, Aichi (JP); Takuya Eguchi, Aichi (JP)

(73) Assignees: Honda Motor Co., Ltd., Tokyo (JP); Omron Automotive Electronics Co., Ltd., Aichi (JP)

( * ) Notice: Subject to any disclaimer, the term of this patent is extended or adjusted under 35 U.S.C. 154(b) by 225 days.

(21) Appl. No.: 13/296,324

(22) Filed: Nov. 15, 2011

(65) Prior Publication Data

US 2012/0125754 A1 May 24, 2012

(30) Foreign Application Priority Data

Nov. 15, 2010 (JP) ..... 2010-254699

(51) Int. Cl.
*H01H 9/26* (2006.01)
*H01H 13/72* (2006.01)
*H01H 13/76* (2006.01)

(52) U.S. Cl.
USPC ..... 200/5 A

(58) Field of Classification Search
USPC ..... 200/5 A, 5 E, 50.03, 553, 293, 200/302.1–302.3, 329, 341, 343, 345
See application file for complete search history.

(56) References Cited

U.S. PATENT DOCUMENTS 5,359,164 A * 10/1994 Kucharski, Jr. ..... 200/315
7,145,090 B2 * 12/2006 Shimizu ..... 200/302.1
7,183,510 B2 2/2007 Ami et al.
7,294,800 B2 * 11/2007 Koyama ..... 200/302.1
7,294,801 B2 * 11/2007 Shimizu ..... 200/302.3
7,297,884 B2 * 11/2007 Shimizu ..... 200/5 R
7,358,453 B2 * 4/2008 Tsunoda ..... 200/339

FOREIGN PATENT DOCUMENTS

| | | | |
|---|---|---|---|
| EP | 1750288 | A2 | 2/2007 |
| JP | 2001102768 | A | 4/2001 |
| JP | 2006172928 | A | 6/2006 |
| JP | 4193824 | B2 | 10/2008 |
| JP | 4280250 | B2 | 3/2009 |
| JP | 4312739 | B2 | 5/2009 |

OTHER PUBLICATIONS

English Patent Abstract of JP 2007-042328, Publication Date: Feb. 15, 2007 (1 Page) (Corresponds with JP 4193824).

(Continued)

*Primary Examiner* — Edwin A. Leon
*Assistant Examiner* — Anthony R. Jimenez
(74) *Attorney, Agent, or Firm* — Osha Liang LLP

(57) ABSTRACT

In the switch device including the case in which switches are accommodated, tube portions provided on an upper surface of the case, operation knobs swingably provided to the tube portions, operation rods for transmitting movement of the operation knobs to the switches, and the cover covering the upper surface of the case while exposing the operation knobs, projections protruding on the side of the cover are provided on the upper surface of the case, projections protruding on the side of the case are provided on a back surface of the cover, and the projections are arranged in a space between the cover and the case formed when the case is covered by the cover so as to be overlapped with each other when seen from the front and back direction.

7 Claims, 13 Drawing Sheets

(56) References Cited

OTHER PUBLICATIONS

English Patent Abstract of JP 2006-351443, Publication Date Dec. 28, 2006 (1 Page) (Corresponds with JP 4280250).

English Patent Abstract of JP 2006-331697, Publication Date Dec. 7, 2006 (1 Page) (Corresponds with JP 4312739).

Extended European Search Report Issued in European Application No. 11189166.9, Dated Feb. 16, 2012 (8 Pages).

* cited by examiner

SWITCH DEVICE

BACKGROUND OF THE INVENTION

1. Technical Field

The present invention relates to a switch device for turning on/off switches by operation of operation knobs, particularly a water proof type switch device for preventing intrusion of water into an interior of a case.

2. Related Art

A switch device for performing opening/closing control of windows, locking/unlocking control, and the like is provided in a vehicle such as an automobile. This type of switch device is generally arranged in a door arm rest, a center console, or the like.

As shown by the reference character 100' in FIG. 12, the above switch device is provided with a case 11', a cover 51' covering an upper surface of the case 11', and operation knobs 21'.

In FIG. 12, an arrow F indicates the front direction of the switch device 100'. Hereinafter, similarly, an arrow B indicates the back direction, an arrow R indicates the right direction, an arrow L indicates the left direction, an arrow U indicates the upward direction, and an arrow D indicates the downward direction. Therefore, FIG. 12 is a side sectional view of a case where the switch device 100' is seen from the left direction L.

Electronic components such as switches 71' and a circuit substrate 72' are accommodated in an interior of the case 11'. Tube portions 12" opening in the up and down direction and communicating with the interior of the case are provided on the upper surface of the case 11'. The operation knobs 21' are attached to the tube portions 12" so as to cover upper openings of the tube portions 12". Further, the operation knobs 21' are operably exposed from holes 52' provided in the cover 51'.

In such a switch device 100', in a case where rainwater intruding from a window left to be open, drinking water spilled from a container, or the like (hereinafter, these are collectively called as the "water") is splashed onto the cover 51', the water runs down to the upper surface of the case 11' through clearances between the holes 52' of the cover 51' and the operation knobs 21' and flows to the side of the tube portions 12" as shown by arrows in the figure.

When an amount of the water flowing to the side of the tube portions 12" is large, the water sometimes rises in clearances between the operation knobs 21' and the tube portions 12", and intrudes into the interior of the case 11' through the openings of the tube portions 12". The water intruding into the interior of the case 11' becomes a cause of corrosion or short in the electronic components such as the switches 71' and the circuit substrate 72'.

Therefore, in Japanese Patent No. 4312739, Japanese Patent No. 4280250, and Japanese Patent No. 4193824, a water proof type switch device for preventing intrusion of water into an interior of a case is proposed.

For example, in the switch device described in Japanese Patent No. 4312739, projections are provided in the vicinity of tube portions to which operation knobs are attached, and in a state that the operation knobs are not swung, lower ends of the operation knobs and upper ends of the projections face each other so as to have minute clearances. Accordingly, even when the water is brought in from an exterior through clearances between a cover and the operation knobs, a flow of the water to rise in clearances between the operation knobs and the tube portions is blocked by the projections.

In the switch device described in Japanese Patent No. 4280250, depressions are provided in the vicinity of tube portions to which operation knobs are attached, and lids covering part of the depressions are provided on the side of the tube portions of the depressions. Accordingly, even when the water is brought in from an exterior through clearances between a cover and the operation knobs, the water running down to an upper surface of a case enters the depressions, and then collides with the lids and circulates in a spiral shape in the depressions. Therefore, a flow of the water to rise in clearances between the operation knobs and the tube portions from the depressions is stopped by the lids.

In the switch device described in Japanese Patent No. 4193824, guide portions having slope surfaces sloping in the left and right direction are provided in the vicinity of front ends of operation knobs on an upper surface of a case. Accordingly, even when the water is brought in from an exterior through clearances between a cover and the operation knobs, the water running down to the vicinity of the front ends of the operation knobs on the upper surface of the case is discharged from opening ends of the guide portions to the left and right sides of the case along the slope surfaces of the guide portions. Therefore, a flow of the water to rise in clearances between the operation knobs and tube portions can be preliminarily prevented.

SUMMARY

As an attachment method of the switch device, as shown in FIG. 12, the switch device 100' is generally attached by such an angle that the front and back direction F, B of the switch device is substantially parallel to a floor surface of the vehicle, that is, the ground.

However, in recent years, due to a demand of users, operation convenience, and the like, a method of attaching the switch device 100' in a state that the front side of the switch device is inclined by a predetermined angle (such as 20° to 30°) in the upward direction U relative to the ground starts being adopted (refer to FIG. 13).

When the switch device 100' is attached in such a way, the water brought in through the clearances between the holes 52' of the cover 51' and the operation knobs 21' runs down to the upper surface of the case 11', and then flows obliquely downward on the upper surface of the case 11' downward inclined toward the tube portions 12" while being accelerated. Therefore, momentum of the water flowing to the side of the tube portions 12" in a clearance between the case 11' and the cover 51' is enhanced in comparison to a case of FIG. 12.

Therefore, as shown by a bold arrow in FIG. 13, the water with the enhanced momentum rises in the clearances between the operation knobs 21' and the tube portions 12", and easily intrudes into the interior of the case 11' through the openings of the tube portions 12".

Thus, an object of the present invention is to provide a switch device capable of preventing a situation that water intrudes into an interior of a case from an exterior of the case via a space between the case and a cover irrespective of an attachment angle of the switch device.

In the present invention, a switch device includes switches, a case in an interior of which the switches are accommodated, tube portions provided on an upper surface of the case, the tube portions opening in the up and down direction of the case and communicating with the interior of the case, operation knobs provided swingably in the front and back direction of the case so as to cover upper openings of the tube portions, operation rods passing through the openings of the tube portions from the operation knobs and extending into the interior of the case, the operation rods for transmitting movement of the operation knobs to the switches, and a cover covering the upper surface of the case while exposing the operation knobs, the operation knobs being arranged so as to be spaced from each other in the front and back direction of the case, wherein a first projection protruding on the side of the cover is provided on the upper surface of the case, a second projection protruding on the side of the case is provided on a back surface of the cover, and the first projection and the second projection are arranged in a space between the cover and the case formed when the case is covered by the cover so as to be overlapped with each other when seen from the front and back direction.

In such a way, a flow of water brought in from an exterior through a clearance between a back end of the operation knob on the front side among the operation knobs arranged in the front and back direction and the cover, the water flowing on the upper surface of the case toward the tube portion on the back side, is blocked by the first projection and the second projection, and the water is discharged to the left and right sides of the case. Therefore, a situation that the water rises in a clearance between the operation knob on the back side and the tube portion and intrudes into the interior of the case from the opening of the tube portion can be prevented.

Particularly, even in a case where the switch device is attached in a state that the front side of the switch device is inclined upward, momentum of the water flowing on the upper surface of the case can be weakened by the first and second projections. Therefore, the water brought in from the exterior can be discharged to the sides of the case irrespective of the attachment angle of the switch device.

In the present invention, preferably, the first projection and the second projection are placed away from each other so as to have a clearance in the front and back direction. In such a way, even in a case where a manufacturer of the case is different from a manufacturer of the cover, and variation of parts of the counterpart manufacturer cannot be grasped, the first projection and the second projection do not collide with each other. Therefore, a situation that the cover cannot be installed to the case can be avoided.

In the present invention, the first projection and the second projection may be provided close to the operation knob on the front side among the operation knobs arranged in the front and back direction.

In such a way, the water flowing on the upper surface of the case toward the tube portion corresponding to the operation knob on the back side can be blocked at a position more distant from the tube portion. Accordingly, intrusion of the water into the interior of the case can be more effectively prevented.

Even when the water runs down to the downward-inclined upper surface of the case in a case where the switch device is attached with the front side being inclined upward, due to a short distance from a running-down point to the projections, the momentum of the water is not increased. Accordingly, the flow of the water toward the tube portion on the back side can be more effectively blocked.

In the present invention, one of the first and the second projections or both of the first and the second projections may be plurally provided.

In such a way, the flow of the water can be further effectively blocked by the three or more projections. Even in a case where part of the projections is broken, the flow of the water can be blocked by the remaining projections.

In the present invention, width in the left and right direction of the first projection and the second projection may be longer than width in the left and right direction of the tube portion on the back side.

In such a way, a situation that the water escaping from the left and right sides of the first and second projections reaches the tube portion positioned on the back side of the projections can be avoided. Therefore, the intrusion of the water into the interior of the case can be more effectively prevented.

In the present invention, in the vicinity of the front side of the tube portion corresponding to the operation knob on the back side among the operation knobs arranged in the front and back direction, a groove portion extending in the left and right direction of the case, the groove portion for flowing water to the sides of the case may be provided.

In such a way, even when the water cannot completely be blocked by the first and second projections, and the water cannot be discharged from the sides of the case, the water with the momentum being weakened by the projections can be discharged from the groove portion to the exterior. Therefore, the intrusion of the water into the interior of the case can be more effectively prevented.

In the present invention, on a front outer surface of the tube portion corresponding to the operation knob on the back side among the operation knobs arranged in the front and back direction, a third projection protruding into a clearance between the operation knob and the tube portion may be provided.

In such a way, even when the water not discharged to the exterior by the first and second projections and the groove portion rises in the clearance between the operation knob and the tube portion and attempts to intrude into the interior of the case from the opening of the tube portion, the flow of the water is blocked by the third projection. Thus, the intrusion of the water into the interior of the case can be more effectively prevented.

According to the present invention, irrespective of the attachment angle of the switch device, the flow of the water brought into the space between the case and the cover from the exterior toward the tube portion is blocked by the first and second projections. As a result, the situation that the water rises in the clearance between the operation knob and the tube portion and intrudes into the interior of the case from the opening of the tube portion can be prevented.

DETAILED DESCRIPTION

Figure 1:
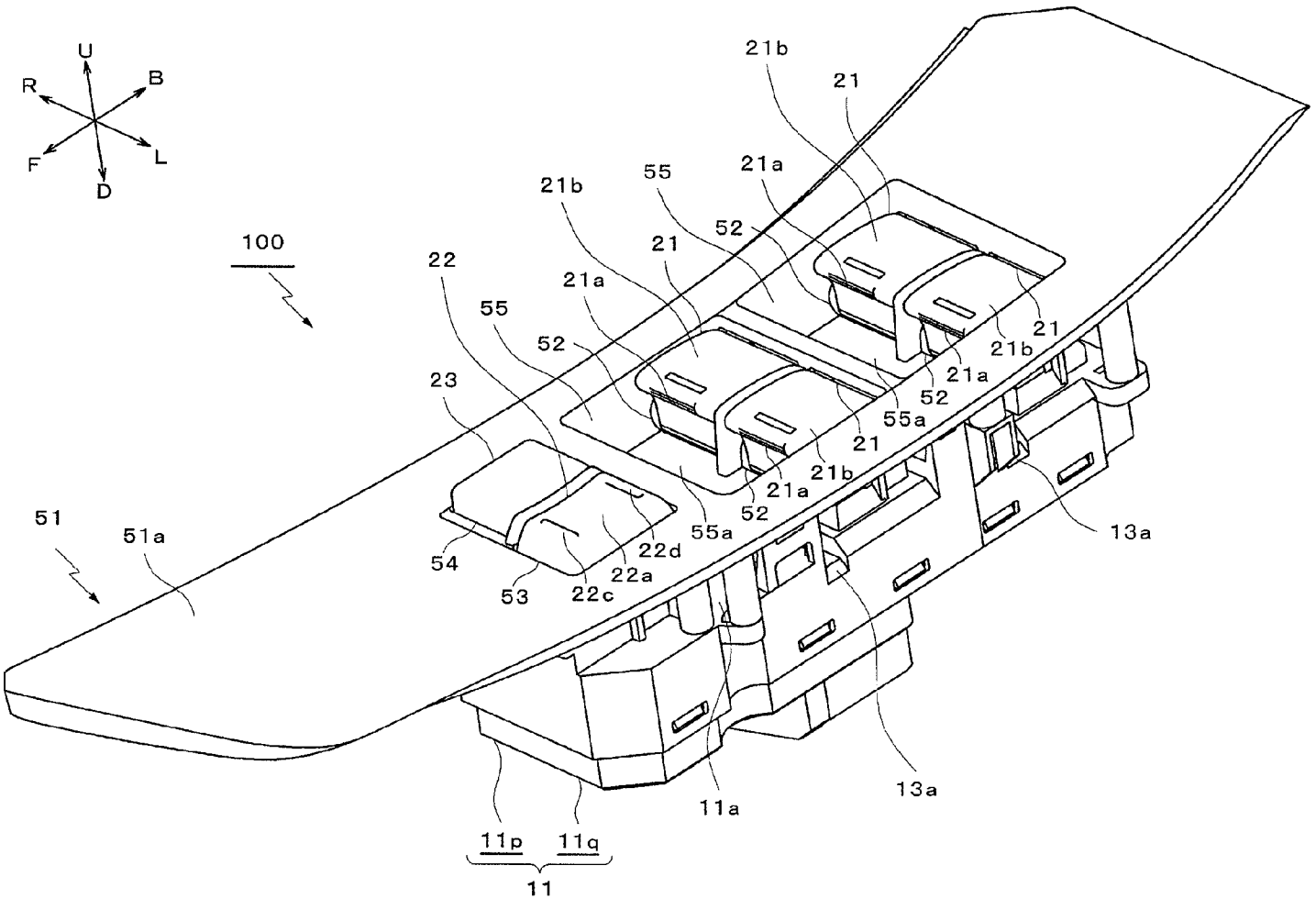
FIG. 1 is an upper perspective view showing an outer appearance of a switch device serving as one embodiment of the present invention.

Hereinafter, an embodiment of the present invention will be described with reference to the drawings. In the following drawings, the same parts or corresponding parts will be given the same reference characters.

Figure 2:
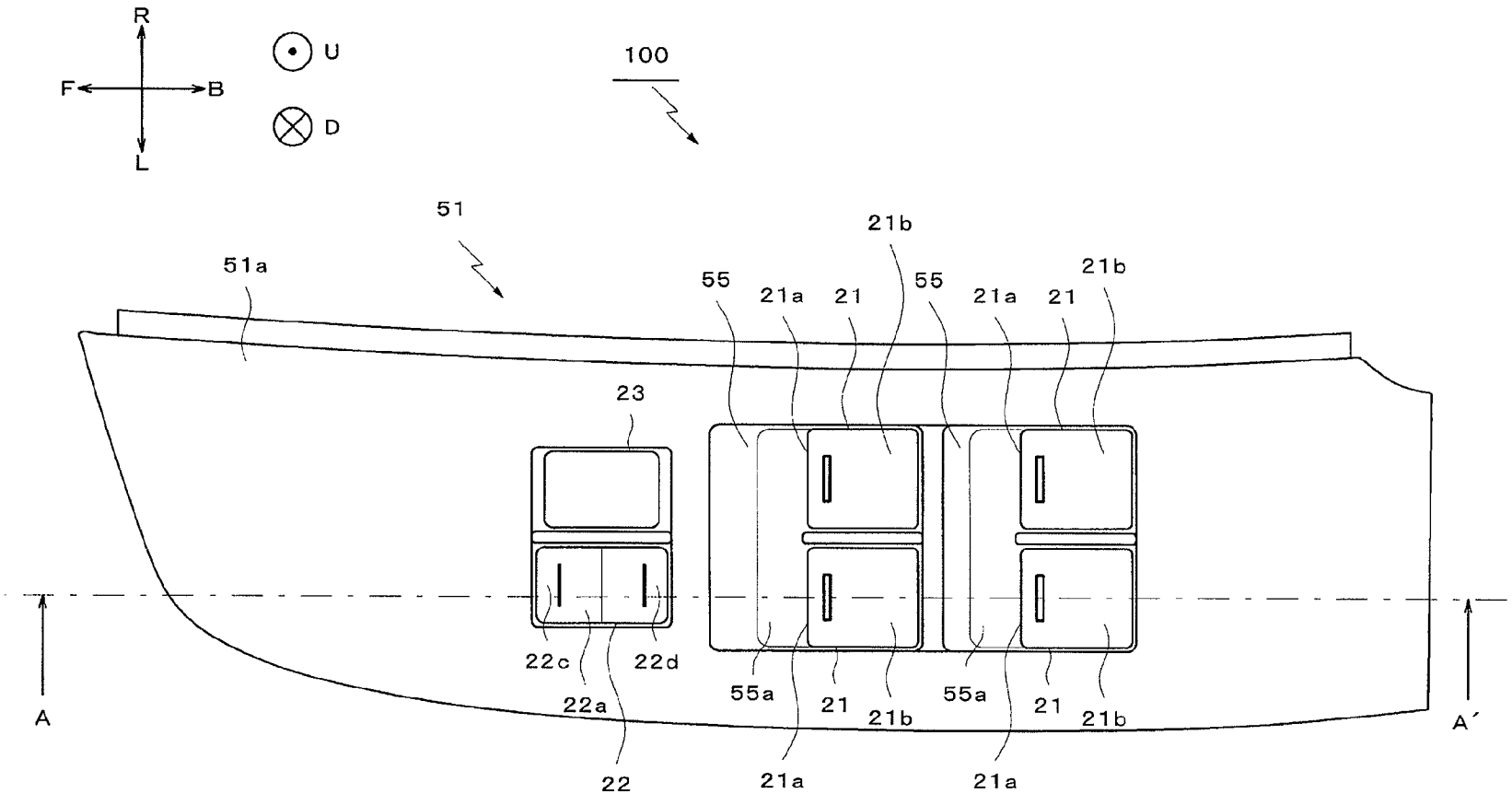
FIG. 2 is a top view of the switch device.
Figure 3:
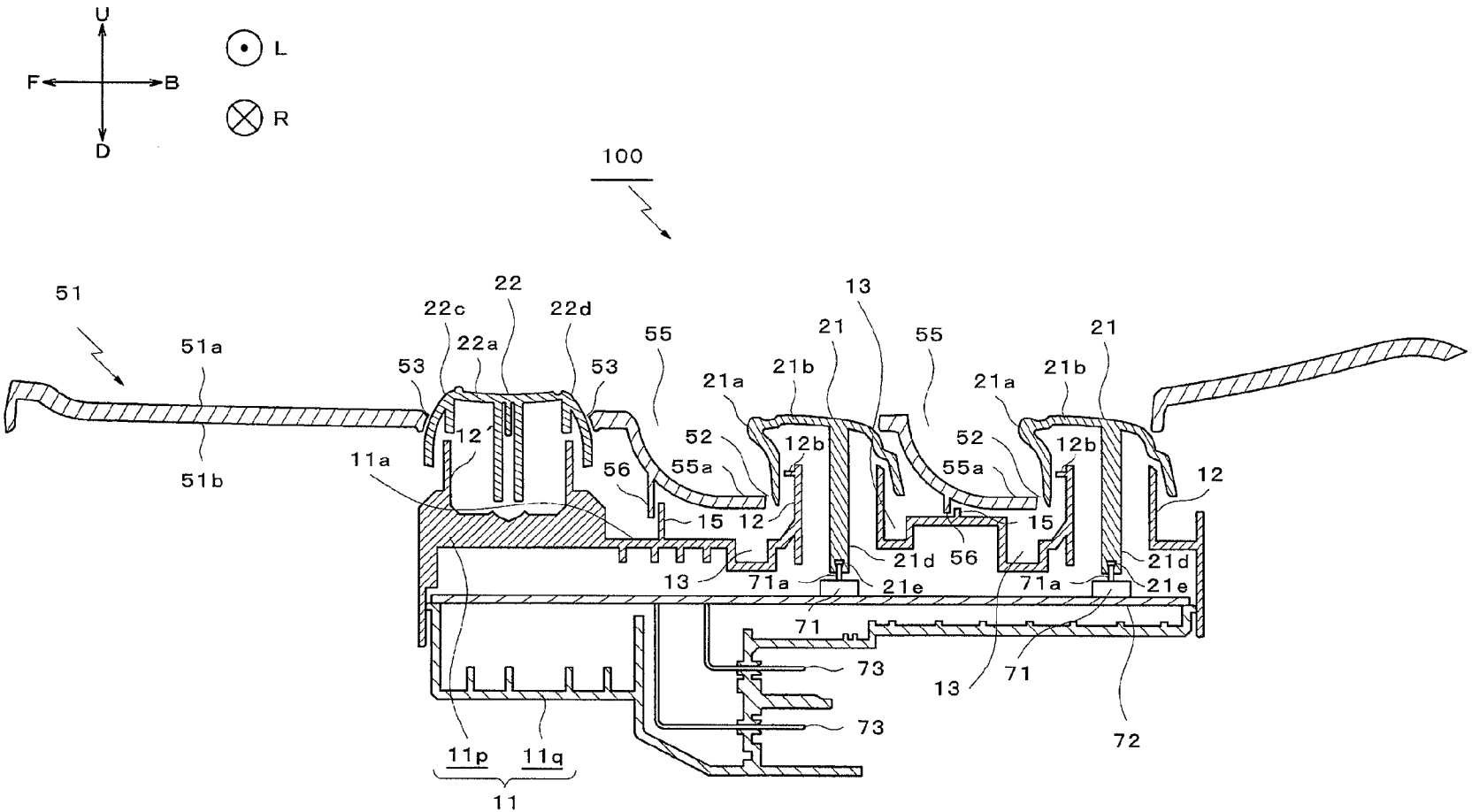
FIG. 3 is a sectional view by line A-A' of FIG. 2.

In FIGS. 1 to 3, arrows U, D, F, B, R, L respectively indicate the upward, downward, front, back, right, and left directions of a switch device 100.

The switch device 100 is used for a power window device, and attached to for example an arm rest (not shown) provided in a door of a driver's seat of a vehicle. This switch device 100 is provided with a case 11, operation knobs 21 to 23, and a cover 51.

Figure 4:
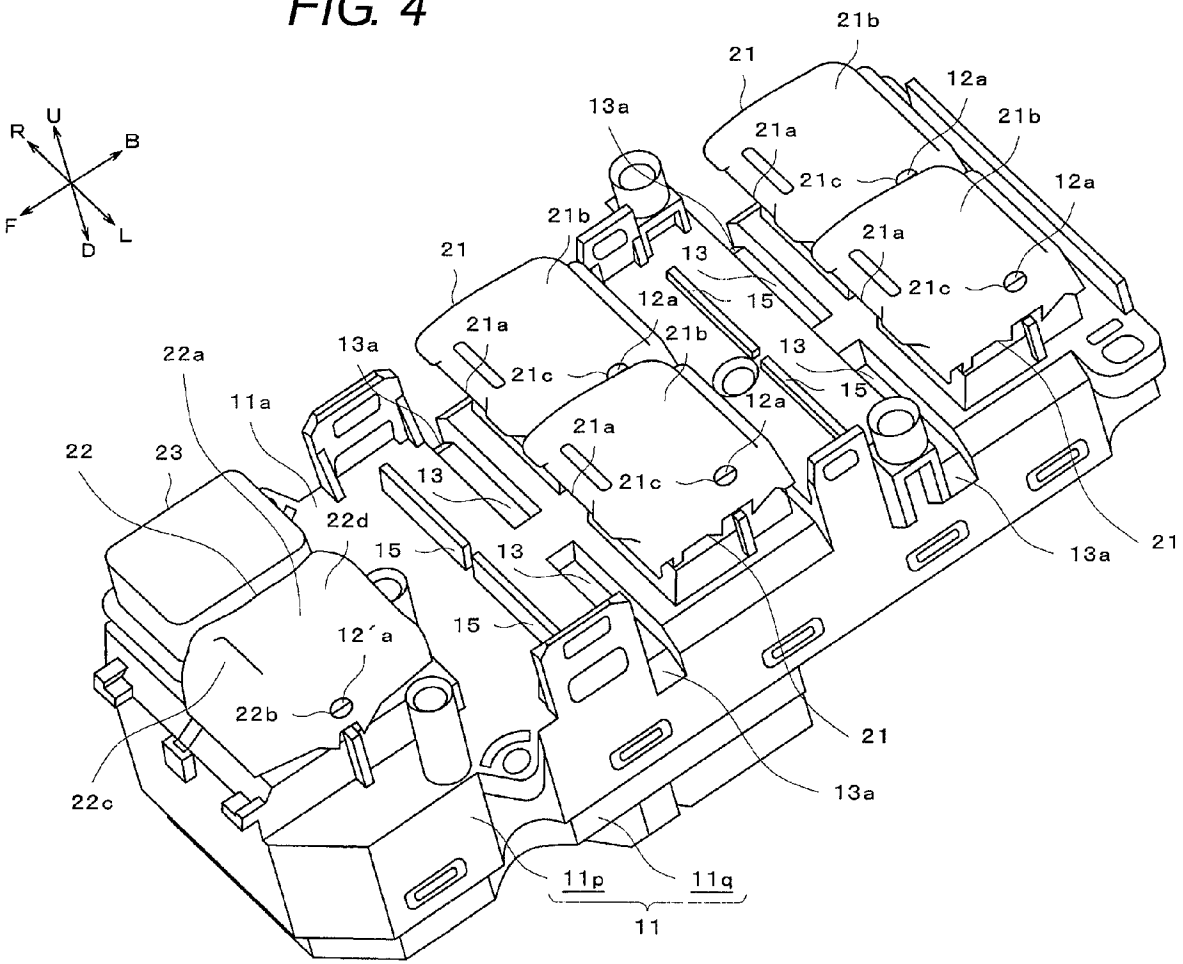
FIG. 4 is an outer appearance view of the switch device in a state that a cover is detached.

As shown in FIG. 4, the case 11 is formed into a rectangular parallelepiped in which length in the left and right direction (L, R direction) is shorter than length in the front and back direction (F, B direction).

As shown in FIG. 3, the case 11 is formed by an upper case 11*p* having an opening on the lower side, and a lower case 11*q* attached to the upper case 11*p* so as to close this opening. Electronic components such as switches 71 and a circuit substrate 72 are accommodated in an interior of the case 11. The reference character 73 denotes a connector installed in the circuit substrate 72. By connecting a cable for providing connection to a control device (not shown) to this connector 73, output signals of the switches 71 can be sent from the switch device 100 to the control device.

As shown in FIG. 3, tube portions 12, groove portions 13, and projections 15 are provided on an upper surface 11*a* of the upper case 11*p*.

The tube portions 12 are hollow tubes opening in the up and down direction (U, D direction) and communicating with the interior of the case 11. A detail of the tube portion 12 is shown in FIG. 7.

Figure 7:
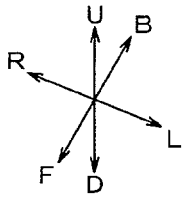
FIG. 7 is an outer appearance view of major parts of a tube portion.
Figure 7:
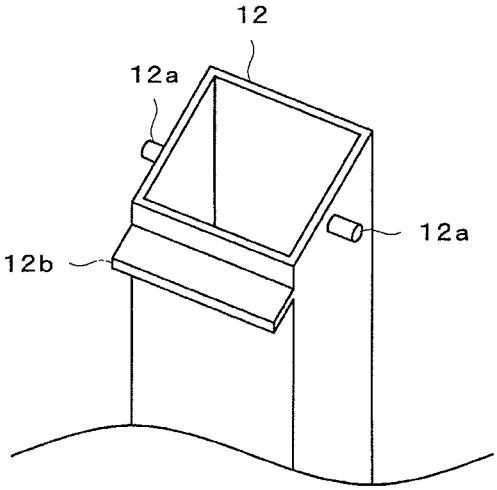

As shown in FIG. 7, a horizontal sectional shape of the tube portion 12 is a substantial rectangle. Shafts 12*a* are integrally formed on left and right outer surfaces of the tube portion 12. Further, a projection 12*b* protruding forward (in the F direction) is integrally formed on a front outer surface of the tube portion 12. This projection 12*b* corresponds to a third projection in the present invention.

It should be noted that although only two tube portions 12 are shown in FIG. 3, in order to attach the operation knobs 21 described later to the tube portions 12, four tube portions 12 are actually provided so as to correspond to the operation knobs 21.

In FIG. 4, the reference characters 21, 22 denote the seesaw type operation knobs, and the reference character 23 denotes the push type operation knob.

In detail, a total of four operation knobs 21 are provided in the switch device 100, and the operation knobs are respectively operated in a case where windows of the driver's seat, a passenger seat, and left and right backseats are opened/closed.

In each of the operation knobs 21, the reference character 21*a* denotes an extending portion extending forward, the reference character 21*b* denotes a cap portion formed integrally with the extending portion 21*a*, and the reference character 21*c* denotes a hole formed in a side wall of the cap portion 21*b*. Another hole 21*c* is also formed in a side wall on the opposite side of the side wall in which the above hole 21*c* is formed. In other words, the two holes 21*c* are formed in the operation knob 21.

In a case where the operation knobs 21 are attached to the tube portions 12, the cap portions 21*b* of the operation knobs 21 are put onto the tube portions 12 so as to cover upper openings of the tube portions 12. After that, the holes 21*c* formed in the side walls of the cap portions 21*b* are fitted to the shafts 12*a* formed on the left and right outer surfaces of the tube portions 12. By the above attachment, the operation knobs 21 are supported on the tube portions 12 so as to be swung in the front and back direction (F, B direction) about the shafts 12*a*.

The reference characters 21*d* (FIG. 3) denote operation rods passing through the tube portions 12 and integrally protruding on the inner side of the operation knobs 21. The operation rods 21*d* pass through the upper openings of the tube portions 12 from the operation knobs 21 and extend into the interior of the case 11.

As shown in FIG. 3, concave portions 21*e* are formed in lower ends of the operation rods 21*d*, and the concave portions 21*e* are fitted to actuators 71*a* of the switches 71 installed in the circuit substrate 72. The switches 71 are switches for opening/closing the windows, formed by known slide switches for example. It should be noted that instead of the slide switches, the switches may be formed by fixed contacts (not shown) formed in the circuit substrate 72 and movable contacts (not shown) provided in the lower ends of the operation rods 21*d*.

In the operation knobs 21 with the above configuration, when the extending portions 21*a* are pushed down or pulled up, the operation knobs 21 are rotated and swung in the front and back direction about the shafts 12*a*, and the operation rods 21*d* transmit movement of the operation knobs 21 to the actuators 71*a*, so that the switches 71 are turned on/off. That is, contacts provided inside the switches 71 are switched to an ON (continuity) or OFF (non-continuity) state in accordance with operation positions of the operation knobs 21. Accordingly, opening/closing operation of the windows is performed.

The operation knob 22 is operated in a case where all boarding doors are locked/unlocked. In the operation knob 22, the reference character 22*a* denotes a cap portion, and the reference character 22*b* denotes a hole formed in a side wall of the cap portion 22*a* (FIG. 4). Another hole 22*b* is also formed in a side wall on the opposite side of the side wall in which the above hole 22*b* is formed. That is, the two holes 22*b* are formed in the operation knob 22.

As well as the operation knobs 21, the holes 22*b* formed in the side walls of the cap portion 22*a* are fitted to shafts 12*a*' (FIG. 4) formed on left and right outer surfaces of a tube portion 12' (FIG. 3), so that the operation knob 22 is supported on the tube portion 12' so as to be swung in the front and back direction (F, B direction) about the shafts 12*a*'.

In the operation knob 22 with the above configuration, when a front end 22*c* of the operation knob 22 is pushed down, all the boarding doors are locked, and when a back end 22*d* of the operation knob 22 is pushed down, all the boarding doors are unlocked.

It should be noted that although a switch operated by the operation knob 22 is installed in the circuit substrate 72 described above, the switch is not shown in FIG. 3.

The operation knob 23 is operated in a case where opening/closing control of the windows of the passenger seat and the backseats is locked/unlocked. In detail, when the operation knob 23 is operated and the operation knob 23 is pushed down, the opening/closing control of the windows described above is locked, so that the windows cannot be opened/closed. When the operation knob 23 is operated and the operation knob 23 is pushed up, the opening/closing control of the windows in a locked state is retrieved (unlocked), so that the windows can be opened/closed.

It should be noted that although a tube portion to which the operation knob 23 is attached is also provided on the upper surface 11*a* of the case 11, the tube portion is not shown in the figure. Although a switch operated by the operation knob 23 is installed in the circuit substrate 72 described above, the switch is not shown in FIG. 3.

The groove portions 13 are provided in the vicinity of the tube portions 12 (refer to FIGS. 3, 4). The groove portions 13 extend in the left and right direction (L, R direction) of the case 11, and ends 13*a* thereof on the side surface side of the case 11 are opened.

The projections 15 are provided between the operation knobs arranged in the front and back direction so as to protrude on the side of the cover 51 (refer to FIG. 3). In detail, as shown in FIG. 4, the four projections 15 are integrally formed on the upper surface 11*a* of the upper case 11*p* so as to extend in the left and right direction (L, R direction) of the case 11. These projections 15 form water shielding walls together with projections 56 on the side of the cover described later, and correspond to a first projection in the present invention.

When seen from the front side of the case 11, two of the projections 15 are placed between the operation knobs in a first row (operation knobs 22, 23) and the operation knobs in a second row (two operation knobs 21), and positioned close to the operation knobs in the first row (refer to FIG. 3). The remaining two projections 15 are placed between the operation knobs in the second row and the operation knobs in a third row (two operation knobs 21), and positioned close to the operation knobs in the second row (refer to FIG. 3).

Height of the projections 15 is set so that front ends of the projections 15 are not abutted with a back surface 51*b* of the cover 51 when the case 11 is covered by the cover 51.

As shown in FIGS. 1 to 3, the cover 51 is to cover the upper surface of the case 11 while exposing the operation knobs (operation knobs 21 to 23).

Figure 5:
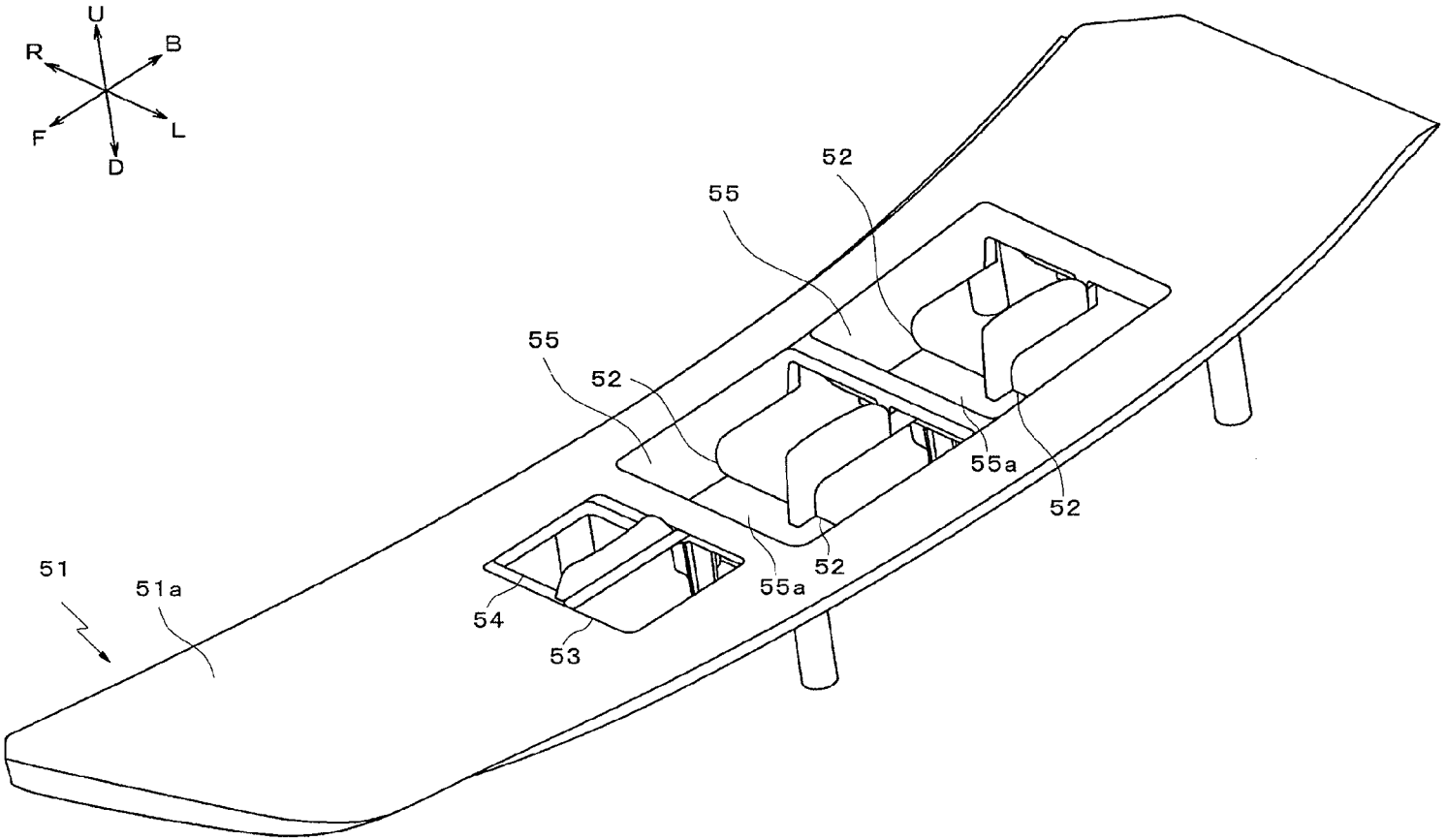
FIG. 5 is an outer appearance view of the surface side of the cover.
Figure 6:
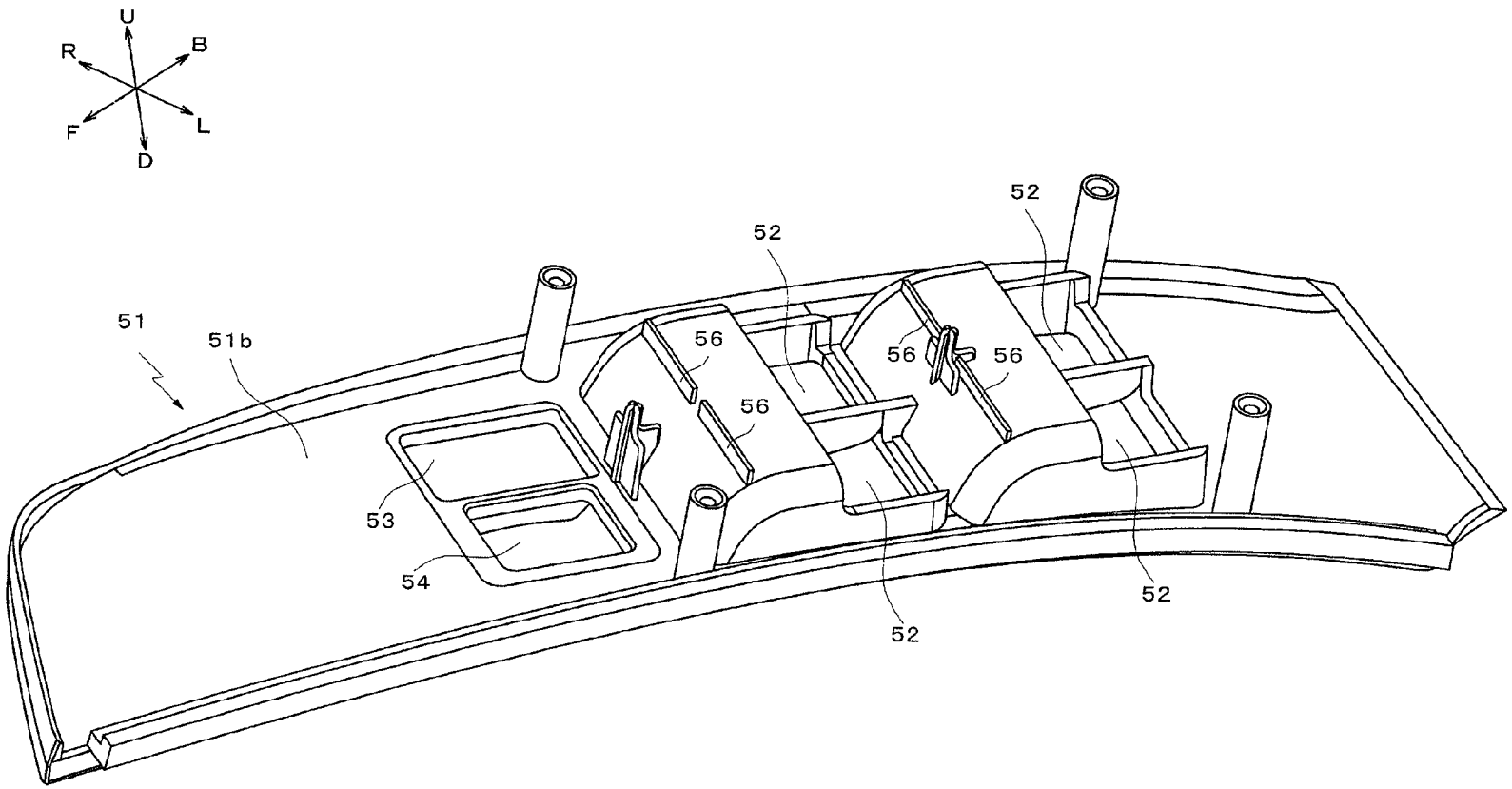
FIG. 6 is an outer appearance view of the back surface side of the cover.

As shown in FIGS. 5 and 6, openings 52 from which the operation knobs 21 are exposed, an opening 53 from which the operation knob 22 is exposed, and an opening 54 from which the operation knob 23 is exposed are formed in the cover 51.

The operation knobs 21 are operated by placing a finger onto the extending portions 21*a* and pushing down and pulling up the extending portions. Therefore, for a purpose of easily placing the finger onto the extending portions 21*a*, concave portions 55 are provided in the cover 51. The openings 52 described above are formed in part of bottom surfaces 55*a* of the concave portions 55.

As shown in FIG. 6, the four projections 56 are integrally formed on the back surface 51*b* of the cover 51 so as to extend in the left and right direction (L, R direction) of the case 11. These projections 56 form the water shielding walls together with the projections 15 on the side of the case described above, and correspond to a second projection in the present invention. As shown in FIG. 3, the projections 56 are provided between the operation knobs arranged in the front and back direction as well as the projections 15.

In detail, when seen from the front side of the cover 51, the two projections 56 among the four projections 56 are placed between the openings in the first row (openings 53, 54) and the openings in the second row (two openings 52), and positioned close to the openings in the first row (refer to FIG. 3).

The operation knobs in the first row described above (operation knobs 22, 23) are exposed from the openings in the first row, and the operation knobs in the second row (two operation knobs 21) are exposed from the openings in the second row. Therefore, it can also be said that the two projections 56 are placed between the operation knobs in the first row and the operation knobs in the second row, and positioned close to the operation knobs in the first row.

The remaining two projections 56 are placed between the openings in the second row and the openings in the third row (two openings 52), and positioned close to the openings in the second row (refer to FIG. 3).

As well as the above description, the operation knobs in the second row described above are exposed from the openings in the second row, and the operation knobs in the third row (two operation knobs 21) are exposed from the openings in the third row. Therefore, it can also be said that the remaining two projections 56 are placed between the operation knobs in the second row and the operation knobs in the third row, and positioned close to the operation knobs in the second row.

Further in detail, these four projections 56 are respectively formed in parts corresponding to the bottom surfaces 55*a* of the concave portions 55 on the back surface 51*b* of the cover 51 (refer to FIG. 3).

Height of the projections 56 is set so that front ends of the projections 56 are not abutted with the upper surface 11*a* of the upper case 11*p* when the case 11 is covered by the cover 51.

When the case 11 is covered by the cover 51, as shown in FIG. 3, the projections 15 and the projections 56 are arranged in a space between the cover 51 and the case 11 so as to be partly overlapped with each other when seen in the front and back direction (F, B direction). The projections 15 and the projections 56 are placed away from each other so as to have clearances in the front and back direction.

Figure 8:
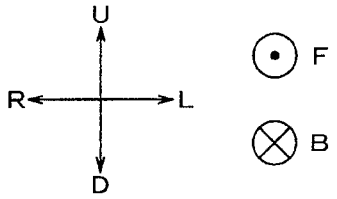
FIG. 8 is a view showing a size relationship of the tube portion and a projection.
Figure 8:
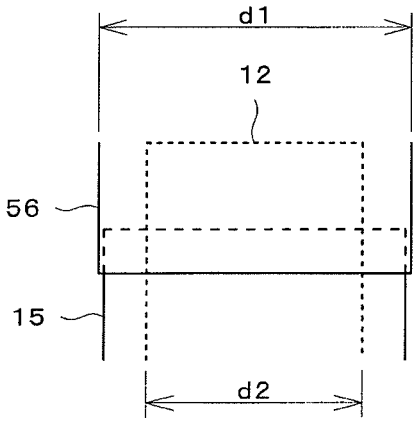

FIG. 8 shows a state that the projection 15 and the projection 56 are overlapped with each other when seen in the front and back direction (F, B direction). Although width d1 in the left and right direction (L, R direction) of the projections 15, 56 and width d2 in the left and right direction of the tube portion 12 may have a relationship of "d1=d2", a relationship of "d1>d2" as in the figure is preferable for a reason described later.

The switch device 100 with the above structure is attached to the arm rest of the door on the side of the driver's seat by inclining the front side of the switch device 100 by a predetermined angle (such as 20° to 30°) in the upward direction U relative to the ground (refer to FIG. 9) from a state shown in FIG. 3 for example.

When a large amount of the water such as the rainwater and the drinking water is splashed onto the cover 51 in such a state, the water is brought into the space between the cover 51 and the upper case 11*p* through clearances formed between the operation knobs 21 and the openings 52, a clearance formed between the operation knob 22 and the opening 53, and the like. The brought-in water runs down to the upper surface 11*a* of the upper case 11*p* downward inclined toward the back side (in the B direction).

The water flowing from the side of the operation knobs in a front row (such as the operation knobs 21 in the second row) to the side of the operation knobs in a back row (such as the operation knobs 21 in the third row) among the water running down to the upper surface 11*a* of the upper case 11*p*, the water being shown by bold arrows in the figure, collides with the projections 56 formed on the back surface 51*b* of the cover 51 and the projections 15 formed on the upper surface 11*a* of the upper case 11*p*. Momentum of the water is weakened by this collision, and major parts of the water do not go beyond the projections 15, 56 but are separated in the left and right direction (L, R direction) and discharged from the sides of the case 11.

That is, a flow of the water flowing on the upper surface 11*a* of the upper case 11*p* toward the tube portions in the back row (such as the tube portions 12 in the third row) is stopped by the projections 15 and the projections 56. Accordingly, a situation that the water flowing on the upper surface 11*a* of the upper case 11*p* rises in clearances between the operation knobs in the back row and the tube portions in the back row by the momentum thereof and intrudes into the interior of the case 11 can be prevented.

Since the projections 15 and the projections 56 are provided close to the operation knobs in the front row, the water flowing on the upper surface 11*a* of the upper case 11*p* can be blocked at a position more distant from the tube portions in the back row.

Accordingly, even when the upper surface 11*a* of the upper case 11*p* is downward inclined toward the back side, due to a short distance from a running-down point of the water to the projections 15, 56, the flow of the water can be blocked by the projections 15, 56 before increasing the momentum of the water flowing on the upper surface 11*a* of the case. Therefore, irrespective of an attachment angle of the switch device 100, intrusion of the water into the interior of the case 11 can be more effectively prevented.

Even in a case where the switch device 100 is horizontally attached, at the time of vehicle travelling on a steep ascent, the switch device 100 is relatively inclined. Thus, the switch device 100 according to the present invention also exerts an effect in such a case.

As shown in FIG. 8, the width d1 in the left and right direction of the projections 15, 56 is larger than the width d2 in the left and right direction of the tube portion 12. Thus, even in a case where the water escapes from the left and right sides of the projections 15, 56, the water does not reach the tube portion 12 positioned on the back side of the projections. Therefore, the intrusion of the water into the interior of the case 11 can be more effectively prevented.

Figure 9:
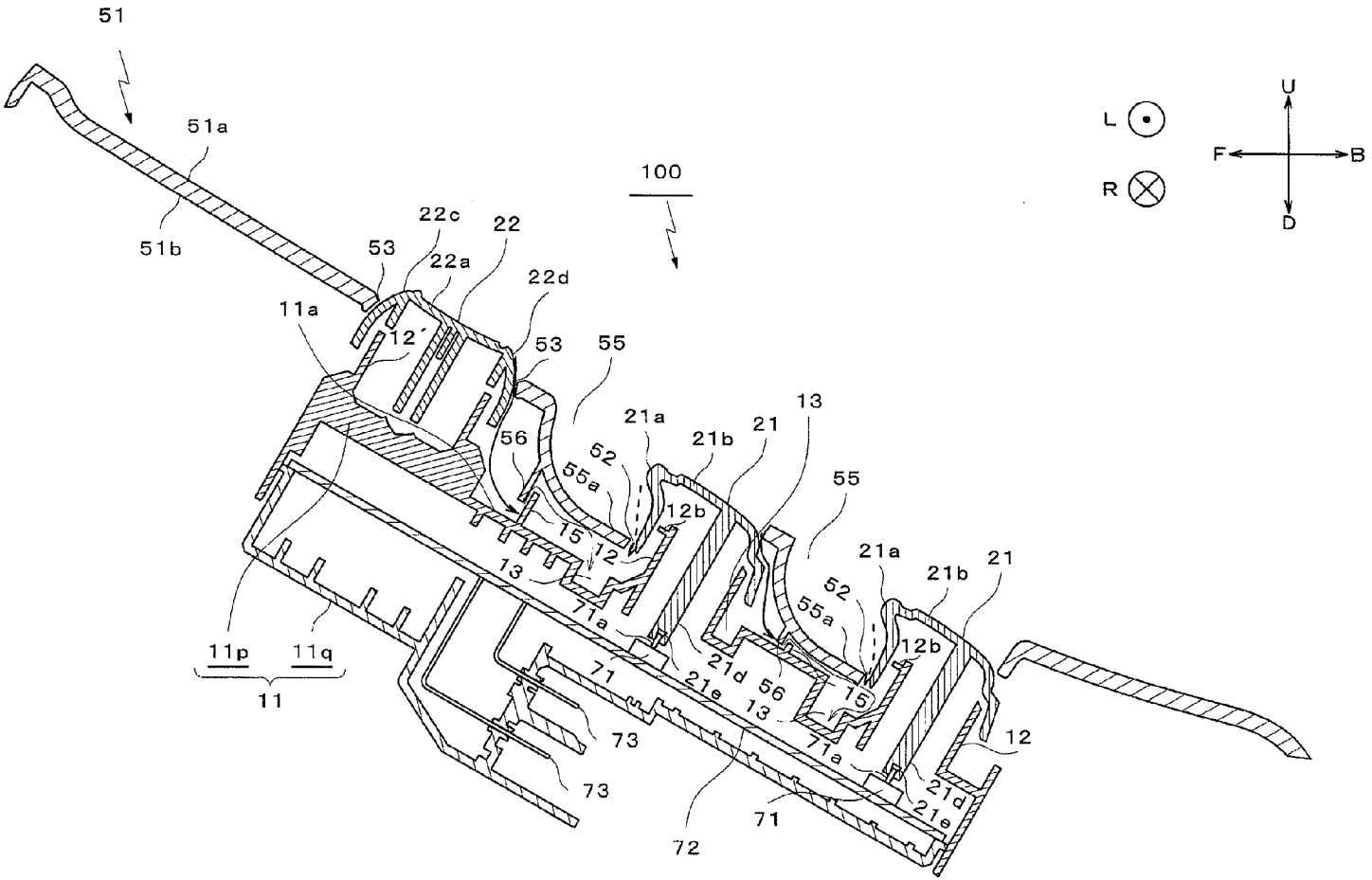
FIG. 9 is a side sectional view of the same switch device which is inclined and attached.

As shown by thin arrows in FIG. 9, even when the water not stopped by the projections 15, 56 flows toward the tube portions 12 in the back row, the momentum of the water is weakened by the projections 15, 56. Therefore, the water going beyond the projections 15, 56 is brought into the groove portions 13 before reaching the tube portions 12, and discharged from the ends 13*a* of the groove portions 13 opening on the side surface side of the case 11 (refer to FIG. 4).

As shown by broken arrows in FIG. 9, even when the water runs down to the vicinity of the tube portions 12 through the openings 52 of the cover 51, the water is brought into the groove portions 13 described above and discharged to the exterior. Therefore, the water does not rise in the clearances between the operation knobs in the back row (such as the operation knobs 21 in the third row) and the tube portions in the back row (such as the tube portions 12 in the third row) and not intrude into the interior of the case 11.

Even when the water not discharged in the groove portions 13 rises in the clearances between the operation knobs in the back row and the tube portions in the back row, the projections 12*b* protruding forward are provided on the front outer surfaces of the tube portions 12, and thus the water is prevented from rising by the projections 12*b* and discharged from the groove portions 13 to the exterior. Therefore, the intrusion of the water into the interior of the case 11 can be furthermore effectively prevented.

In the present embodiment, as described above, the projections 15 and the projections 56 are placed away from each other so as to have the clearances in the front and back direction (F, B direction) (refer to FIG. 3). Therefore, even in a case where a manufacturer of the case 11 is different from a manufacturer of the cover 51, and variation of parts of the counterpart manufacturer cannot be grasped, the projections 15, 56 do not collide with each other. Accordingly, a situation that the cover 51 cannot be installed to the case 11 can be avoided.

Although the projections 15 and the projections 56 are arranged as in FIG. 3 in the embodiment described above, the present invention is not limited only to this.

Figure 10A:
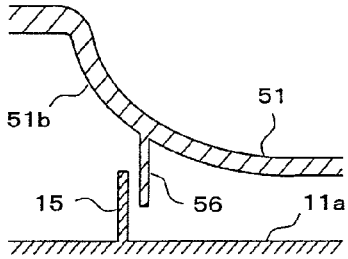
FIGS. 10A to 10G are sectional views of major parts showing formation examples of the projections.

For example, as shown in FIG. 10A, a position of the projection 15 may be replaced by a position of the projection 56, so that the projection 15 is provided on the front side of the projection 56.

Figure 10B:
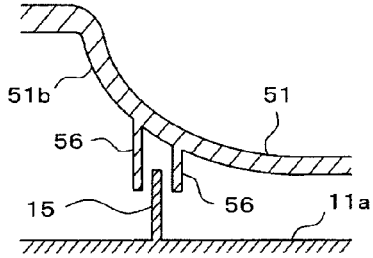
Figure 10C:
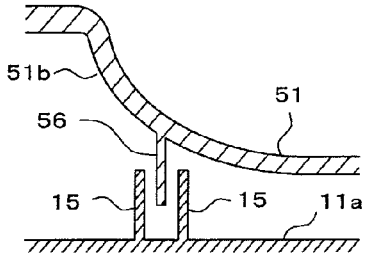
Figure 10D:
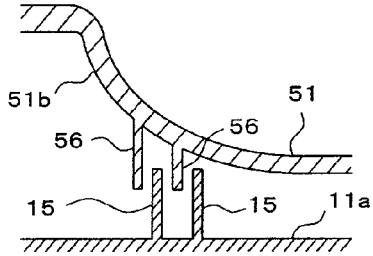

As shown in FIGS. 10B to 10D, one of the projection 15 and the projection 56 or both of the projection 15 and the projection 56 may be plurally provided. In such a way, the flow of the water can be further effectively blocked by the three or more projections. Moreover, for example, even in a case where part of the projections is broken, the flow of the water can be blocked by the remaining projections.

Figure 10E:
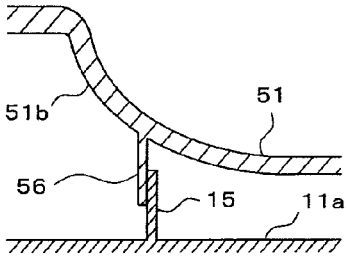

As shown in FIG. 10E, the projection 15 is not placed away from the projection 56 but both the projections 15, 56 may be in contact with each other. In a case where the same manufacturer manufactures the case 11 and the cover 51, the variation of the parts can be managed. Thus, such arrangement can be performed. Accordingly, since there is no clearance between both the projections 15, 56, the flow of the water can be further effectively blocked.

Figure 10F:
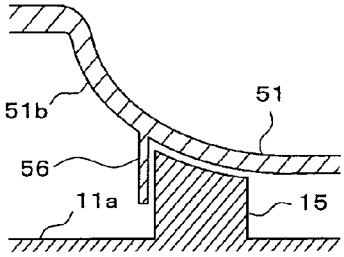

As shown in FIG. 10F, the width of the projection 15 on the side of the case may be increased, so that a long passage between the projection 15 and the cover 51 is ensured. In such a way, the water does not easily go beyond the projections 15, 56 even more.

Figure 10G:
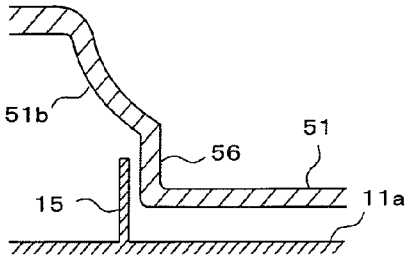

Further, as shown in FIG. 10G, part of the cover 51 may also serve as the projection 56.

Although the four projections 15 on the side of the case and the four projections 56 on the side of the cover are provided so as to respectively correspond to the tube portions 12 in the embodiment described above, the present invention is not limited only to this.

Figure 11:
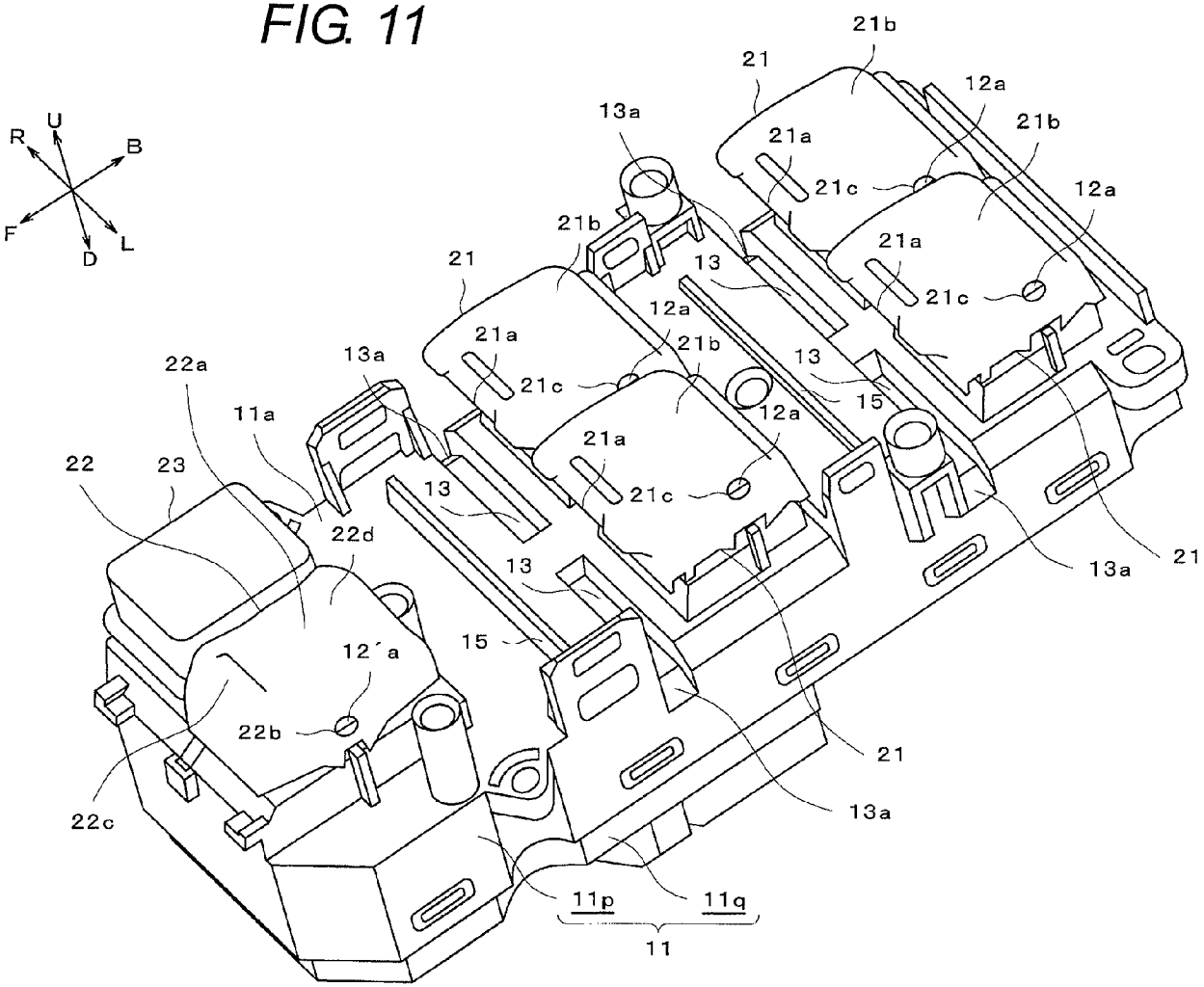
FIG. 11 is an outer appearance view showing another embodiment of the present invention.
Figure 12:
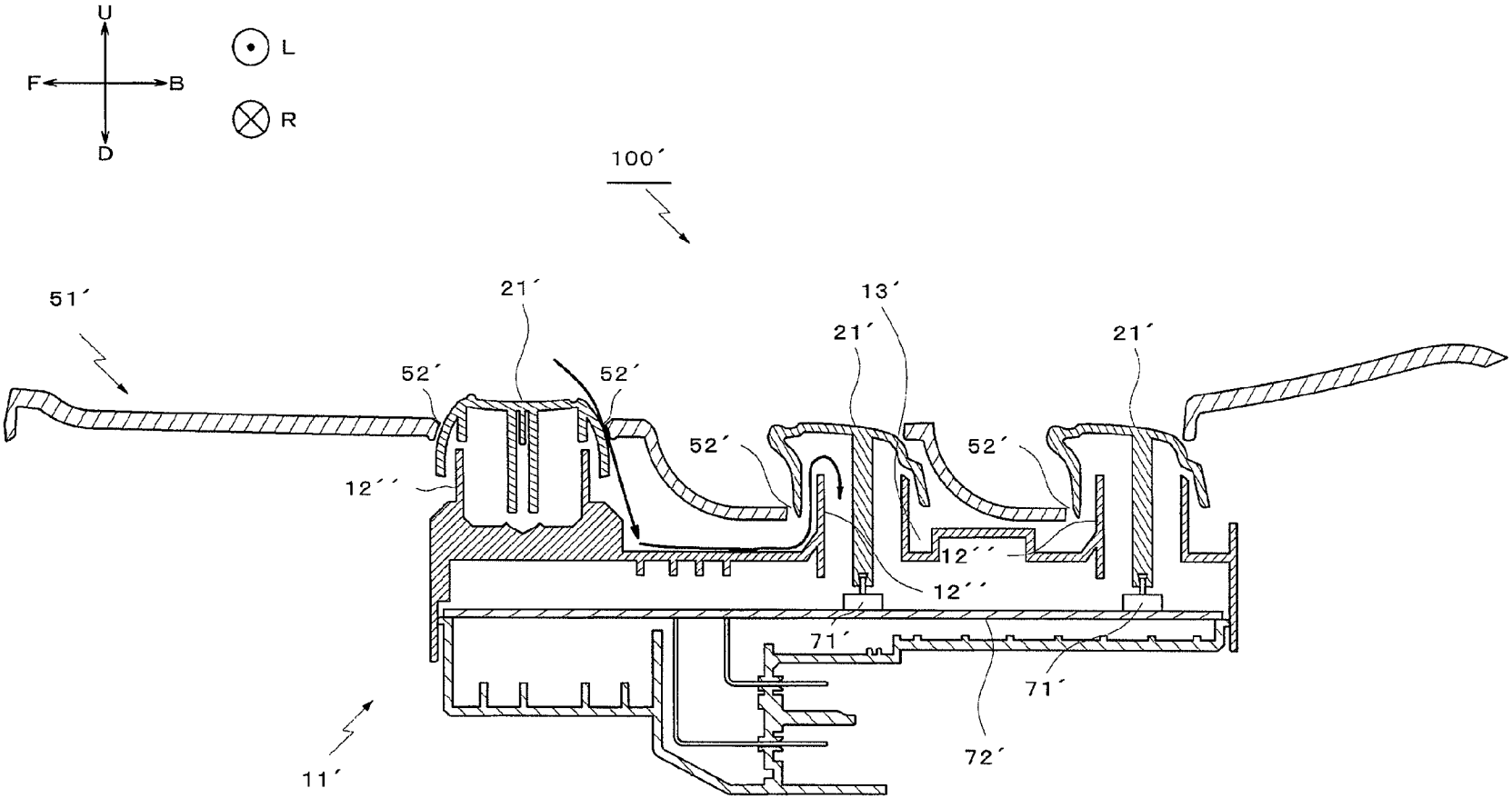
FIG. 12 is a side sectional view of a conventional switch device.
Figure 13:
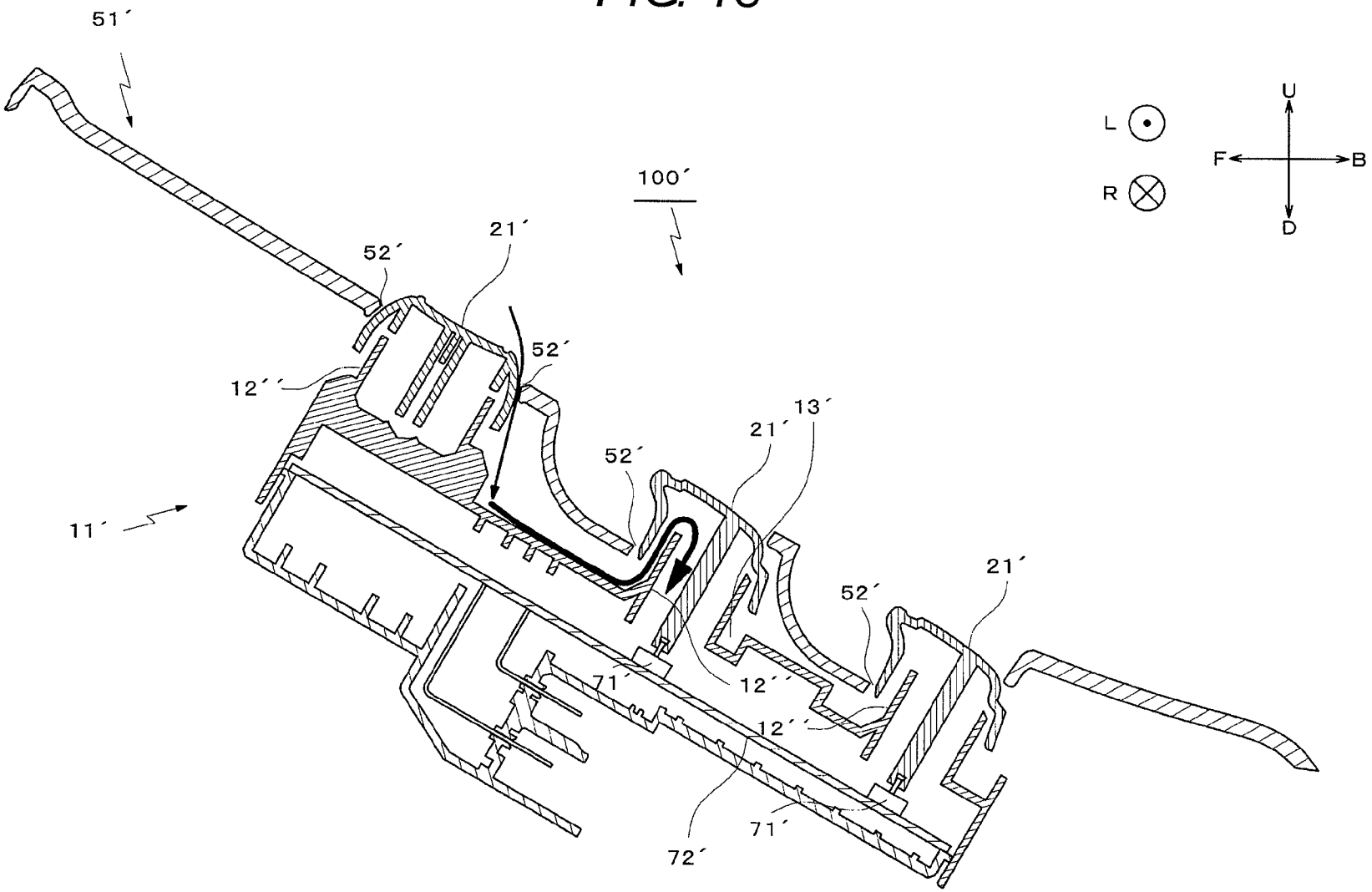
FIG. 13 is a side sectional view of the conventional switch device which is inclined and attached.

For example, regarding to the projection 15 on the side of the case, one projection 15 with large width in the left and right direction may be provided as shown in FIG. 11. In this case, regarding the projection 56 on the side of the cover, one projection 56 with large width in the left and right direction is also provided so as to face the projection 15 (not shown).

An example that the present invention is applied to the switch device 100 used for the power window device provided with the four switches for opening/closing the windows is taken in the embodiment described above. However, the present invention can also be applied to a switch device provided with not four but a plurality of switches for opening/closing windows, a switch device used for a door opening/closing device, and the like. The present invention can also be applied to a switch device used for other purposes than a switch device installed in the vehicle.

What is claimed is:

1. A switch device, comprising:

switches;

a case having an interior in which the switches are accommodated;

tube portions provided on an upper surface of the case, the tube portions opening in an up and down direction of the case and communicating with the interior of the case;

operation knobs provided swingably in a front and back direction of the case so as to cover upper openings of the tube portions;

operation rods passing through the openings of the tube portions from the operation knobs and extending into the interior of the case, the operation rods configured to transmit movement of the operation knobs to the switches; and a cover covering the upper surface of the case while exposing the operation knobs, the operation knobs being arranged so as to be spaced from each other in the front and back direction of the case, wherein a first projection protruding on a side of the cover is provided on the upper surface of the case, a second projection protruding on a side of the case is provided on a back surface of the cover, and the first projection and the second projection are arranged in a space between the cover and the case formed when the case is covered by the cover so as to be overlapped with each other when seen from the front and back direction.

2. The switch device according to claim 1, wherein the first projection and the second projection are placed away from each other so as to have a clearance in the front and back direction.

3. The switch device according to claim 1, wherein the first projection and the second projection are provided closer to the frontmost operation knob than the other operation knobs arranged in the front and back direction.

4. The switch device according to claim 1, wherein one of the first and the second projections or both of the first and the second projections are plurally provided.

5. The switch device according to claim 1, wherein a width in a left and right direction of the first projection and the second projection is longer than a width in the left and right direction of the backmost tube portion in the front and back direction.

6. The switch device according to claim 1, wherein a groove portion for flowing water to a side of the case is provided near a front side of the tube portion corresponding to the backmost operation knob in the front and back direction, the groove portion extending in the left and right direction of the case.

7. The switch device according to claim 1, wherein a third projection is provided on a front outer surface of the tube portion corresponding to the backmost operation knob in the front and back direction, the third projection protruding into a clearance between the operation knob and the tube portion corresponding to the backmost operation knob.

* * * * *